US010981381B2

(12) United States Patent
Nagamochi et al.

(10) Patent No.: US 10,981,381 B2
(45) Date of Patent: Apr. 20, 2021

(54) LIQUID DISCHARGE HEAD SUBSTRATE, LIQUID DISCHARGE HEAD, AND LIQUID DISCHARGE APPARATUS

(71) Applicant: CANON KABUSHIKI KAISHA, Tokyo (JP)

(72) Inventors: Soichiro Nagamochi, Kawasaki (JP); Takeshi Aoki, Oita (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 7 days.

(21) Appl. No.: 16/526,055

(22) Filed: Jul. 30, 2019

(65) Prior Publication Data

US 2020/0039222 A1 Feb. 6, 2020

(30) Foreign Application Priority Data

Aug. 6, 2018 (JP) ..... JP2018-148023

(51) Int. Cl.
*B41J 2/05* (2006.01)
*B41J 2/14* (2006.01)

(52) U.S. Cl.
CPC .. *B41J 2/14201* (2013.01); *B41J 2002/14491* (2013.01)

(58) Field of Classification Search
CPC ... B41J 2/14016; B41J 2/14129; B41J 2/1623
See application file for complete search history.

(56) References Cited

U.S. PATENT DOCUMENTS 6,513,911 B1 * 2/2003 Ozaki ..... B41J 2/055 347/58
9,705,066 B2 7/2017 Hamaguchi et al.
2004/0160485 A1 * 8/2004 Imanaka ..... B41J 2/14072 347/58
2006/0071281 A1 * 4/2006 Dodd ..... B41J 2/1603 257/368
2009/0027450 A1 * 1/2009 Park ..... B41J 2/14129 347/47
2015/0298457 A1 * 10/2015 Ohmura ..... B41J 2/14016 347/61
2016/0263890 A1 9/2016 Hamaguchi et al.

FOREIGN PATENT DOCUMENTS

JP 2016-165875 A 9/2016

* cited by examiner

*Primary Examiner* — Lam S Nguyen
(74) *Attorney, Agent, or Firm* — Venable LLP

(57) ABSTRACT

A liquid discharge head substrate comprising a liquid discharge element arranged above a surface of a substrate, an insulator arranged between the surface and the liquid discharge element, a liquid supply port extending through the insulator, first and second conductive patterns is provided. The first pattern connects an element arranged on the surface and the liquid discharge element. The second pattern surrounds the liquid supply port. The insulator includes first and second films that are bonded at a bonding surface along the surface. A first member arranged in the first film and a second member arranged in the second film, of the first pattern, are bonded at the bonding surface. A third member arranged in the first film and a fourth member arranged in the second film, of the second pattern, are bonded at the bonding surface.

22 Claims, 9 Drawing Sheets

LIQUID DISCHARGE HEAD SUBSTRATE, LIQUID DISCHARGE HEAD, AND LIQUID DISCHARGE APPARATUS

BACKGROUND OF THE INVENTION

Field of the Invention

The present invention relates to a liquid discharge head substrate, a liquid discharge head, and a liquid discharge apparatus.

Description of the Related Art

A liquid discharge head is widely used in a printing apparatus that prints information such as characters and images on a print medium such as paper or a film. In Japanese Patent Laid-Open No. 2016-165875, there is disclosed a liquid discharge head obtained by bonding a driving circuit substrate, on which semiconductor elements are formed, and a channel forming substrate, on which discharged elements are formed.

SUMMARY OF THE INVENTION

In the liquid discharge head disclosed in Japanese Patent Laid-Open No. 2016-165875, a manifold for supplying ink goes through a bonding portion for bonding the driving circuit substrate and a channel forming substrate. If the manifold is filled with a liquid such as ink when the liquid discharge head is operated, the bonding portion comes into contact with the liquid, and the bonding portion may be eroded in some cases. If the erosion reaches electrically conductive patterns for electrically connecting the driving circuit substrate and the channel forming substrate, a short circuit may occur between the electrically conductive patterns via the liquid, and the reliability of the liquid discharge head will degrade.

Some embodiments of the present invention provide a technique for suppressing the degradation of the reliability of a liquid discharge head substrate used in a liquid discharge head.

According to some embodiments, a liquid discharge head substrate comprising: a substrate; a semiconductor element arranged on a principal surface of the substrate; a liquid discharge element arranged above the principal surface and configured to discharge a liquid; an insulating film arranged between the principal surface and the liquid discharge element; a liquid supply port which extends through the substrate and the insulating film; a first electrically conductive pattern arranged in the insulating film to electrically connect the semiconductor element and the liquid discharge element; and a second electrically conductive pattern arranged in the insulating film so as to surround the liquid supply port in an orthogonal projection with respect to the principal surface, wherein the insulating film includes a first insulating film and a second insulating film arranged between the first insulating film and the liquid discharge element, the first insulating film and the second insulating film are bonded at a bonding surface extending in a direction along the principal surface, the first electrically conductive pattern includes a first electrically conductive member arranged in the first insulating film and a second electrically conductive member arranged in the second insulating film, the first electrically conductive member and the second electrically conductive member are bonded at the bonding surface, the second electrically conductive pattern includes a third electrically conductive member arranged in the first insulating film and a fourth electrically conductive member arranged in the second insulating film, and the third electrically conductive member and the fourth electrically conductive member are bonded at the bonding surface, is provided.

According to some other embodiments, a liquid discharge head substrate comprising: a substrate; a semiconductor element arranged on a principal surface of the substrate; a liquid discharge element arranged above the principal surface; an insulating film arranged between the principal surface and the liquid discharge element; a liquid supply port which extends through the substrate and the insulating film; an electrically conductive pattern arranged in the insulating film to electrically connect the semiconductor element and the liquid discharge element, wherein the insulating film includes a first insulating film and a second insulating film arranged between the first insulating film and the liquid discharge element, the first insulating film and the second insulating film are bonded at a bonding surface extending in a direction along the principal surface, the electrically conductive pattern includes a first electrically conductive member arranged in the first insulating film and a second electrically conductive member arranged in the second insulating film, the first electrically conductive member and the second electrically conductive member are bonded at the bonding surface, and a protective pattern is arranged so as to cover at least a bonding portion of the first insulating film and the second insulating film of wall surfaces of the liquid supply port, is provided.

Further features of the present invention will become apparent from the following description of exemplary embodiments (with reference to the attached drawings).

DESCRIPTION OF THE EMBODIMENTS

Embodiments of a liquid discharge head substrate according to the present invention will now be described in detail with reference to the accompanying drawings. In the following description and drawings, common signs denote common arrangements throughout a plurality of drawings. Common arrangements will be described by cross-referencing to a plurality of drawings, and a description of arrangements denoted by common signs will be omitted appropriately.

Figure 1A:
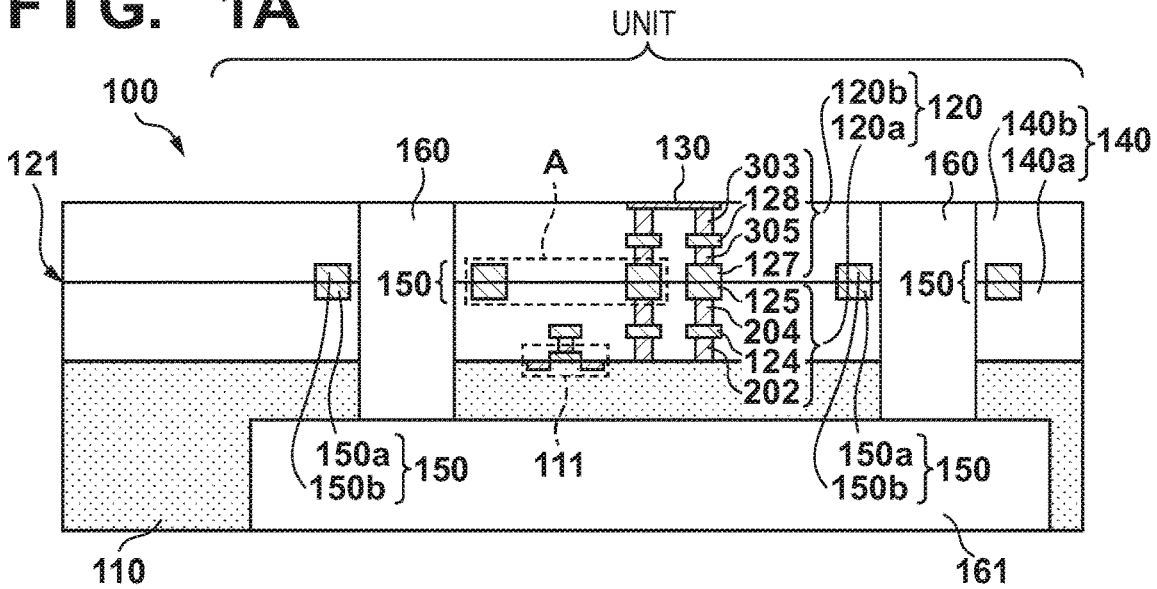
FIGS. 1A to 1E are views showing an example of the arrangement of a liquid discharge head substrate according to an embodiment of the present invention.
Figure 1B:
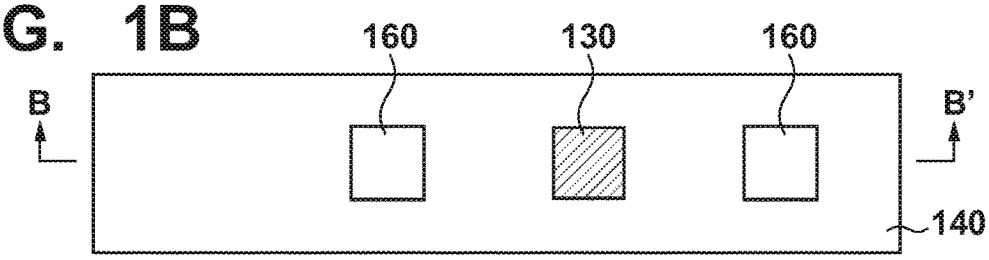
Figure 1C:
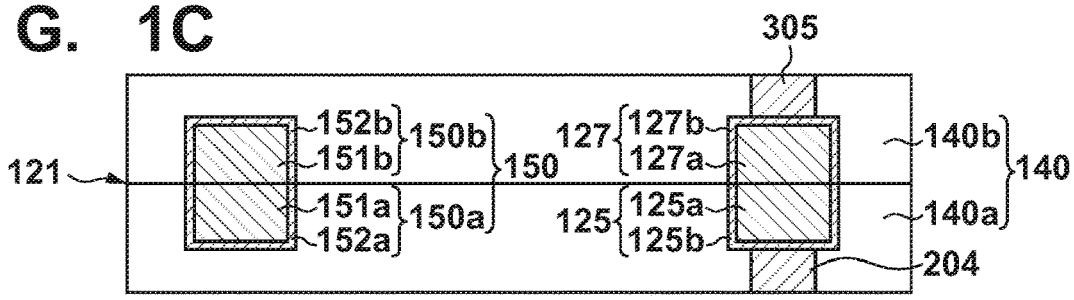
Figure 1D:
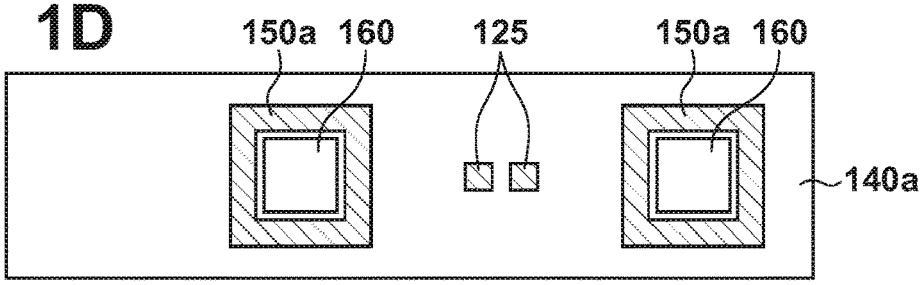
Figure 1E:
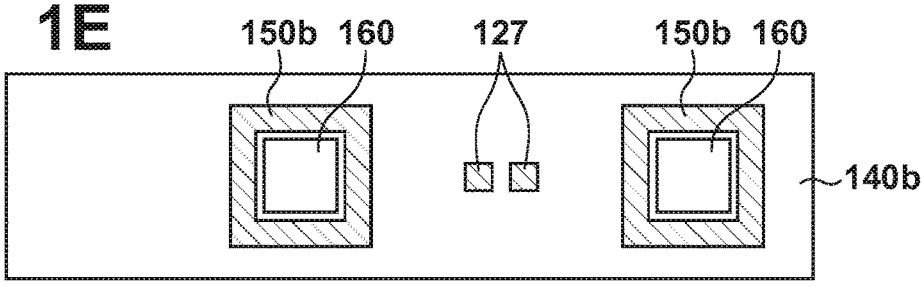

The structure and the manufacturing method of a liquid discharge head substrate according to an embodiment of the present invention will be described with reference to FIGS. 1A to 4C. FIG. 1A is sectional view showing an example of the arrangement of a liquid discharge head substrate 100 according to the first embodiment of the present invention, FIG. 1B is a plan view of the liquid discharge head substrate 100, and FIG. 1C is an enlarged view of a portion encircled by a dotted line A in FIG. 1A. Here, FIG. 1A is a view showing a section taken along a line B-B' of FIG. 1B. FIGS. 1D and 1E are a top view and a bottom view, respectively, of a bonding surface 121 of FIG. 1A. In this specification, a direction from a substrate 110 toward the bonding surface 121 will be referred to as an "upward" direction. It will be described for example, that a liquid discharge element 130 is arranged above the substrate 110 in FIG. 1A.

The liquid discharge head substrate 100 is used in a liquid discharge apparatus such as a multi-function peripheral, a facsimile, a word processor, or the like. The following embodiments will show a case in which a heat generating resistive element is used as the liquid discharge element 130 for discharging a liquid provided in the liquid discharge head substrate 100. However, the present invention is not limited to this. The liquid discharge element 130 need only be an element that can apply energy to the liquid to discharge the liquid, and for example, a piezoelectric element or the like may be used.

The liquid discharge head substrate 100 includes the substrate 110, a semiconductor element 111 which is arranged on the principal surface of the substrate 110, the liquid discharge element 130 which is arranged above the principal surface of the substrate 110 and used for discharging liquid, and an insulating film 140 which is arranged between the principal surface of the substrate 110 and the liquid discharge element 130. The liquid discharge head substrate 100 also includes an electrically conductive pattern 120 (first electrically conductive pattern) which is arranged in the insulating film 140 to electrically connect the semiconductor element 111 to the liquid discharge element 130. The liquid discharge head substrate 100 also includes liquid supply ports 160 which extend through the substrate 110 and the insulating film 140 to supply the liquid to the liquid discharge element 130. In this embodiment, two liquid supply ports 160 are arranged with respect one liquid discharge element 130, and each liquid supply port 160 is connected to a common liquid chamber 161. In addition, the liquid discharge head substrate 100 includes electrically conductive patterns 150 (second electrically conductive patterns) each having a guard ring structure and arranged inside the insulating film 140 so as to surround the corresponding liquid supply port 160 in an orthogonal projection to the principal surface of the substrate 110. In this embodiment, a single unit UNIT is formed by the semiconductor element 111, the liquid discharge element 130, the electrically conductive pattern 120, the liquid supply ports 160, and the electrically conductive patterns 150 shown in FIG. 1A. The liquid discharge head substrate 100 is formed by arranging (forming) a plurality of units UNIT on the substrate 110 or in the insulating film 140 on the substrate 110. In this embodiment, two liquid supply ports 160 are arranged with respect to one liquid discharge element 130 arranged a single unit. However, for example, one liquid supply port 160 may be arranged in a single unit or three or more liquid supply ports 160 may be arranged. In addition, the common liquid chamber 161 may be, for example, shared among the plurality of units UNIT.

A semiconductor substrate made of, for example, silicon or the like can be used as the substrate 110. The semiconductor element 111 such as transistor and an element isolation region (not shown) such as LOCOS, STI, or the like are formed in the substrate 110.

The insulating film 140 includes an insulating film 140*a* (first insulating film) and an insulating film 140*b* (second insulating film) arranged between the insulating film 140*a* and the liquid discharge element 130. The insulating film 140*a* and the insulating film 140*b* have a stacked structure in which the films have been bonded to each other at the bonding surface 121 extending in a direction along the principal surface of the substrate 110. The bonding surface 121 can be almost parallel to the principal surface of the substrate 110. The insulating film 140 can be made of various kinds of insulating materials such as silicon oxide, silicon nitride, silicon oxynitride, and the like.

The electrically conductive pattern 120 includes an electrically conductive pattern 120*a* which includes an electrically conductive member 125 (first electrically conductive member) arranged in the insulating film 140*a* and an electrically conductive pattern 120*b* which includes an electrically conductive member 127 (second electrically conductive member) arranged in the insulating film 140*b*. The electrically conductive member 125 and the electrically conductive member 127 are bonded to each other at the bonding surface 121. The electrically conductive pattern 120*a* also includes an electrically conductive member 124 arranged inside the insulating film 140*a*. The electrically conductive members 124 and 125 can be, for example, wiring patterns. The electrically conductive member 124, which is the member closest to the substrate 110 among the electrically conductive members 124 and 125 arranged over a plurality of layers, is electrically connected via a plug 202 to the semiconductor element 111 and the like formed on the substrate 110. The electrically conductive member 124 and the electrically conductive member 125 are connected to each other via a plug 204. The electrically conductive pattern 120*b* includes an electrically conductive member 128 arranged in the insulating film 140*b*. The electrically conductive members 127 and 128 can be, for example, wiring patterns. The electrically conductive member 128, which is a member farthest from the substrate 110 among the electrically conductive members 127 and 128 arranged over a plurality of layers, is electrically connected to the liquid discharge element 130 via a plug 303. The electrically conductive member 127 and the electrically conductive member 128 are connected to each other via a plug 305.

Each electrically conductive pattern 150 includes an electrically conductive member 150*a* (third electrically conductive member) arranged in the insulating film 140*a* and an electrically conductive member 150*b* (fourth electrically conductive member) arranged in the insulating film 140*b*. Each electrically conductive member 150*a* and each electrically conductive member 150*b* are bonded to each other at the bonding surface 121. As shown in FIGS. 1D and 1E, each electrically conductive member 150*a* and each electrically conductive member 150*b* are arranged so as to surround the periphery of the corresponding liquid supply port 160. When a liquid discharge apparatus equipped with the liquid discharge head substrate 100 is used, the liquid supply ports 160 and the common liquid chamber 161 are filled with the liquid to be discharged by using the liquid discharge element 130. If the bonding portion between the insulating films 140*a* and 140*b* of the bonding surface 121 is eroded by the liquid, there is a possibility that a short circuit will occur between the electrically conductive patterns 120*a* and 120*b* via the liquid, and the reliability of the liquid discharge head may degrade. Hence, each electrically conductive pattern 150 is arranged so as to surround the periphery of the corresponding liquid supply port 160. Although the specific details will be described later, a material to be used to form the electrically conductive patterns 150 is selected so that the resistance of the bonding portion of the electrically conductive member 150*a* and the electrically conductive member 150*b* of each electrically conductive pattern 150 to the liquid will be higher than the resistance of the bonding portion of the insulating film 140*a* and the insulating film 140*b* to the liquid. In addition, as shown in FIGS. 1A, 1D, and 1E, in each unit UNIT, the electrically conductive pattern 120 is not arranged between each electrically conductive pattern 150 and the corresponding liquid supply port 160 surrounded by the electrically conductive pattern 150.

Each electrically conductive pattern 150 including the electrically conductive members 150*a* and 150*b* can have conductivity in a similar manner to the electrically conductive pattern 120. In this case, in each unit UNIT, the electrically conductive patterns 150 may be electrically insulated from the electrically conductive pattern 120 and the semiconductor element 111 which are arranged in the same unit UNIT. That is, the electrically conductive patterns 150 and the electrically conductive pattern 120 need not be electrically connected to each other. In other words, each electrically conductive pattern 150 may be an electrically conductive pattern that does not contribute to signal transmission or power supply. Hence, the electrically conductive patterns 150 can be used in an electrically floating state when the liquid discharge apparatus equipped with the liquid discharge head substrate 100 is operated. In addition, when the liquid discharge apparatus is operated, a predetermined potential may be applied to the electrically conductive patterns 150 (to be described later).

The bonding portion of the electrically conductive pattern 120*a* and the electrically conductive pattern 120*b* and the bonding portion of each electrically conductive member 150*a* and each electrically conductive member 150*b* can have the same structure and be made of the same material. More specifically, the electrically conductive members 150*a* and 150*b* and the electrically conductive members 125 and 127 can have the same stacked structure including an identical barrier metal layer and an identical metal layer. The barrier metal layers of the electrically conductive members 150*a* and 150*b* and the electrically conductive members 125 and 127 are formed by, for example, tantalum, a tantalum compound, titanium, or a titanium compound and suppress a material included in the metal layer from diffusing or interacting. The metal layers of the electrically conductive members 150*a* and 150*b* and the electrically conductive members 125 and 127 are formed by, for example, a metal such as copper which has a resistance lower than the barrier metal layer.

As shown in FIG. 1C, the electrically conductive member 125 can be formed by including a metal layer 125*a* and a barrier metal layer 125*b*. The barrier metal layer 125*b* is arranged between the metal layer 125*a* and the insulating film 140*a*. The electrically conductive member 127 can be formed by including a metal layer 127*a* and a barrier metal layer 127*b*. The barrier metal layer 127*b* is arranged between the metal layer 127*a* and the insulating film 140*b*. Each electrically conductive member 150*a* can be formed by including a metal layer 151*a* (first metal layer) and a barrier metal layer 152*a* (first barrier metal layer). The barrier metal layer 152*a* is arranged between the metal layer 151*a* and the insulating film 140*a*. Each electrically conductive member 150*b* can be formed by including a metal layer 151*b* (second metal layer) and a barrier metal layer 152*b* (second barrier metal layer). Each barrier metal layer 152*b* can be arranged between the metal layer 151*b* and the insulating film 140*b*. The metal layer 125*a* and the metal layer 127*a*, the barrier metal layer 125*b* and the barrier metal layer 127*b*, the metal layer 151*a* and the metal layer 151*b*, the barrier metal layer 152*a* and the barrier metal layer 152*b*, the insulating film 140*a* and the insulating film 140*b* are bonded to each other at the bonding surface 121. As shown in FIG. 1C, the upper surface of the electrically conductive member 125, the upper surface of the electrically conductive member 150*a*, and the upper surface of the insulating film 140*a* are flush with each other, and the lower surface of the electrically conductive member 127, the lower surface of the electrically conductive member 150*b*, and the lower surface of the insulating film 140*b* are flush with each other. Also, as shown in FIG. 1C, each electrically conductive member 150*a* and the electrically conductive member 125 may have the same height in a direction intersecting with (for example, perpendicular to) the principal surface of the substrate 110. In a similar manner, each electrically conductive member 150*b* and the electrically conductive member 127 may have the same height in the direction intersecting with the principal surface of the substrate 110. In other words, the barrier metal layers and the metal layers of the electrically conductive members 150*a* and 150*b* and that of the electrically conductive members 125 and 127 may have the same thickness. As will be described later, the liquid discharge head substrate 100 is manufactured by bonding two substrates. The surfaces by which these two substrates are bonded become the bonding surface 121.

The liquid discharge element 130 is positioned on the electrically conductive pattern 120. The semiconductor element 111 and the liquid discharge element 130 are electrically connected to each other by the electrically conductive pattern 120 (more specifically, by the conductive material included in the electrically conductive pattern 120). As described above, in this embodiment, a heat generating resistive element is used as the liquid discharge element 130, and can be formed by, for example, tantalum or a tantalum compound. The heat generating resistive element may also be formed by polysilicon, tungsten, or a tungsten compound. The number of the liquid discharge elements 130 to be arranged in one unit UNIT need not be limited to one, and two or more liquid discharge elements 130 may be arranged in one unit UNIT. A protective film can be arranged on the liquid discharge element 130 so the liquid will not directly come into contact with the liquid discharge element 130. For example, silicon nitride may be used as the protective film. Furthermore, an anti-cavitation film using, for example, tantalum or a tantalum compound may be arranged on the protective film.

The manufacturing method of the liquid discharge head substrate 100 will be described next with reference to FIGS. 2A to 4B. The formation of a substrate 200 which is a portion including the semiconductor element 111 from the substrate 110 to the bonding surface 121 of the liquid discharge head substrate 100 will be described first with reference to FIGS. 2A to 2F.

Figure 2A:
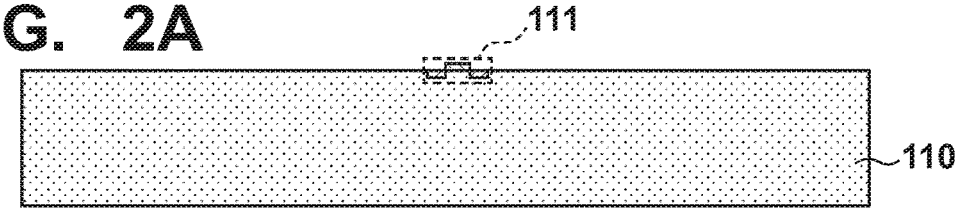
FIGS. 2A to 2F are views showing an example of a manufacturing method of the liquid discharge head substrate of FIG. 1A.

First, as shown in FIG. 2A, in the formation of the substrate 200, the semiconductor element 111 and an element isolation region (not shown) are formed in the substrate 110 made of a semiconductor material such as silicon.

The semiconductor element 111 may be, for example, a switch element such as a transistor. The element isolation region may be formed by LOCOS or STI.

Figure 2B:
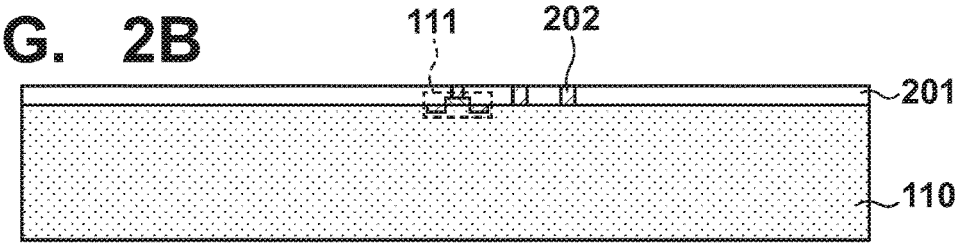

Next, an insulating layer 201 which is to be a part of the insulating film 140*a* is deposited on the substrate 110 on which the semiconductor element 111 is formed. After the deposition of the insulating layer 201, a hole is opened at a predetermined position in the insulating layer 201, and the plug 202 is formed in the hole as shown in FIG. 2B. The plug 202 is, for example, formed by forming a metal film made of tungsten or the like on the insulating layer 201 and using an etch-back method or a CMP method to remove portions of the metal film other than the portion in the hole opened in the insulating layer 201. In the formation of the plug 202, tungsten may be deposited after forming a barrier metal layer by using titanium or a titanium compound. For example, $SiO_2$ is used for the insulating layer 201. The upper surface of the insulating layer 201 may be planarized by performing a CMP process when the plug 202 is formed.

Figure 2C:
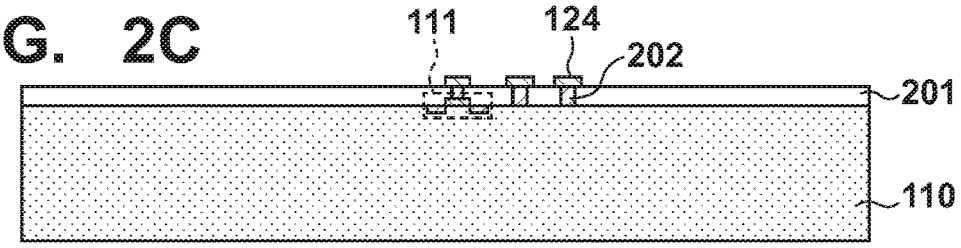

As shown in FIG. 2C, the electrically conductive member 124 is formed on the insulating layer 201 after the formation of the plug 202. The electrically conductive member 124 can be made of, for example, aluminum. A metal film made of, for example, aluminum or the like for forming the electrically conductive member 124 is deposited on the insulating layer 201, and a mask pattern having a desired shape is formed on this metal film. Next, the electrically conductive member 124 is formed by etching the metal film via the opening of the mask pattern.

Figure 2D:
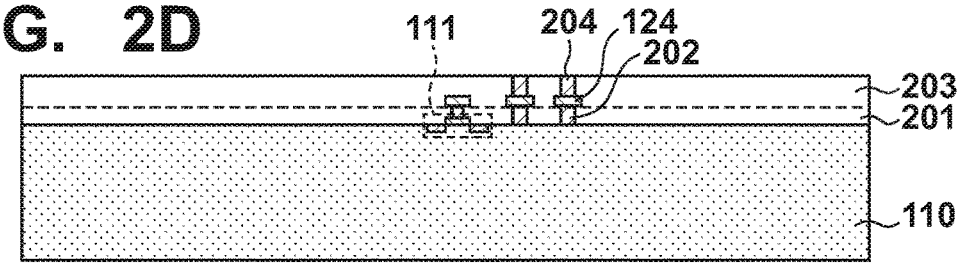

As shown in FIG. 2D, after the formation of the electrically conductive member 124, an insulating layer 203 which is to be a part of the insulating film 140*a* is formed on the insulating layer 201 and the electrically conductive member 124, and the plug 204 is formed on the insulating layer 203. The plug 204 may include the barrier metal layer and the metal layer or only the metal layer. For example, titanium or a titanium compound is used for the barrier metal layer. Also, for example, tungsten is used for the metal layer. For example, $SiO_2$ is used for the insulating layer 203.

Figure 2E:
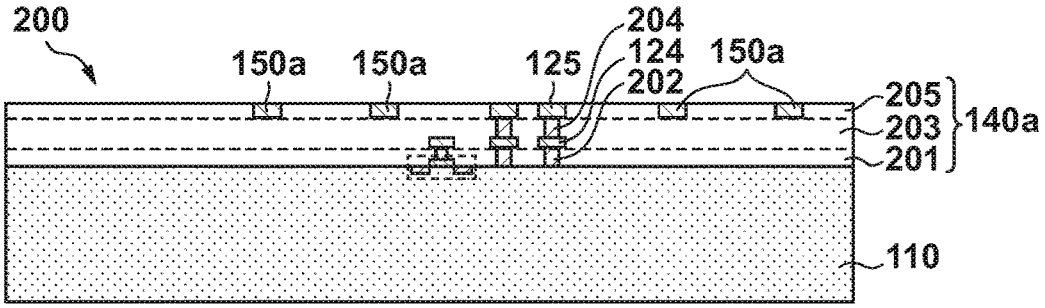
Figure 2F:
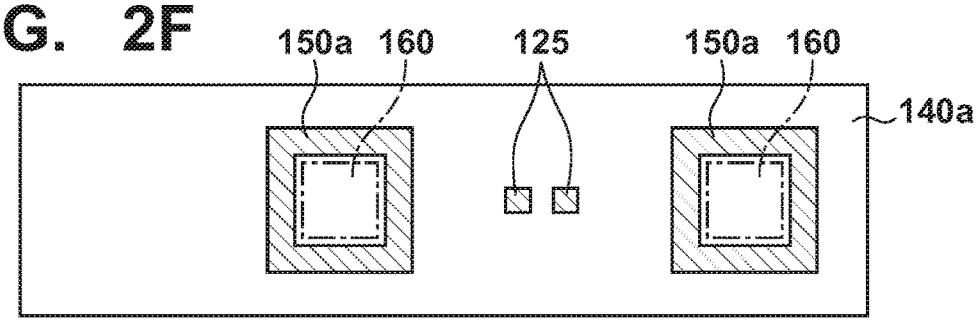

After the insulating layer 203 and the plug 204 are formed, an insulating layer 205 which is to be a part of the insulating film 140*a*, the electrically conductive member 125, and the electrically conductive members 150*a* are formed on the insulating layer 203 as shown in FIG. 2E. FIG. 2F is a plan view of FIG. 2E, and each electrically conductive member 150*a* is arranged as a guard ring structure surrounding the periphery of the corresponding liquid supply port 160 to be formed in a later process.

The electrically conductive member 125 and the electrically conductive members 150*a* can be formed simultaneously by using a damascene method. In this case, the electrically conductive member 125 and the electrically conductive members 150*a* can be formed by the same material and have the same height in the direction intersecting with the principal surface of the substrate 110. As described above, each of the electrically conductive member 125 and the electrically conductive members 150*a* can include a corresponding one of the barrier metal layers 125*b* and 152*a* and a corresponding one of the metal layers 125*a* and 151*a*. For example, tantalum, a tantalum compound, titanium, or a titanium compound is used for the barrier metal layers 125*b* and 152*a*. Also, for example, copper is used for the metal layers 125*a* and 151*a*. In addition, for example, $SiO_2$ is used for the insulating layer 205.

The substrate 200 is formed by the above processes. Although the substrate 200 includes two layers of the electrically conductive members 124 and 125 in this embodiment, the number of layers on which the electrically conductive members are to be arranged is not limited to this. The number of layers on which the electrically conductive members are to be arranged may be one or may be three or more. The electrically conductive members 124 and 125 and the plugs 202 and 204 form the electrically conductive pattern 120*a* of the liquid discharge head substrate 100 described above. In addition, although the insulating film 140*a* includes the insulating layer 201, the insulating layer 203, and the insulating layer 205 in this embodiment, the number of insulating layers to be included in the insulating film 140*a* can be changed appropriately in accordance with the number of layers to be arranged with the electrically conductive members.

In addition, although each electrically conductive member 150*a* has a one-layer structure in this embodiment, it may have two or more layers. In a case in which the electrically conductive member 150*a* has a structure composed of two or more layers, one layer of the electrically conductive member 150*a* among the plurality of layers of the electrically conductive member 150*a* will be exposed at the surface of the substrate 200. Also, in a case in which the electrically conductive member 150*a* is formed by two or more layers, the electrically conductive members 150*a* arranged on the respective layers may be connected to each other by a plug.

The formation of a substrate 300 which forms a portion on the side of the bonding surface 121 to the liquid discharge element 130 of the liquid discharge head substrate 100 will be described next with reference to FIGS. 3A to 3F. Although the formation of the substrate 200 has been described first in this specification, the order of the formation of the substrate 200 and the formation of the substrate 300 is not particularly limited to this. The substrate 200 may be manufactured first, the substrate 300 may be manufactured first, or the substrate 200 and the substrate 300 may be manufactured simultaneously.

Figure 3A:
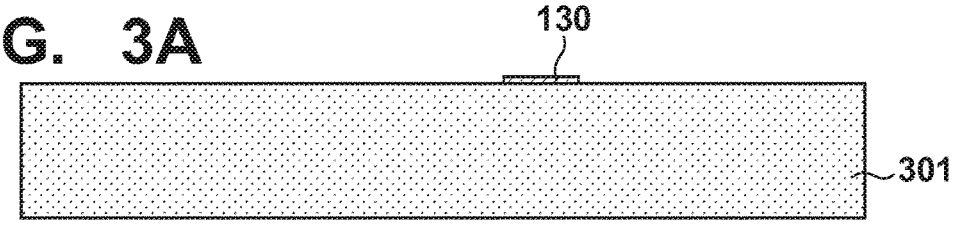
FIGS. 3A to 3F are views showing an example of the manufacturing method of the liquid discharge head substrate of FIG. 1A.

First, as shown in FIG. 3A, the liquid discharge element 130 is formed on a substrate 301. A semiconductor substrate made of silicon or an insulating substrate such as glass may be used as the substrate 301. In this embodiment, the liquid discharge element 130 which is a heat generating resistive element is formed by using, for example, tantalum, a tantalum compound, polysilicon, tungsten, or a tungsten compound. Also, a protective film using silicon nitride or the like may be formed on the substrate 301 before the liquid discharge element 130 is formed. A material which has etching selectivity between the substrate 301 and the protective film during the process of removing the substrate 301 (to be described later) can be used as the protective film.

Figure 3B:
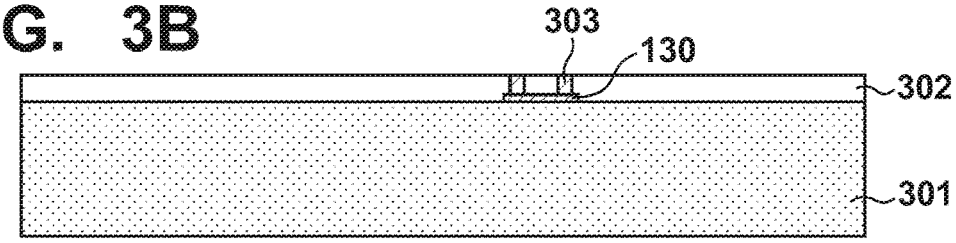

An insulating layer 302 which is to be a part of the insulating film 140*b* is formed on the substrate 301 and the liquid discharge element 130 after the formation of the liquid discharge element 130. After the insulating layer 302 is formed, a hole is opened at a predetermined position on the insulating layer 302, and the plug 303 is formed in the hole as shown in FIG. 3B. The plug 303 is formed, for example, by forming a metal film made of tungsten or the like on the insulating layer 302 and using the etch-back method or the CMP method to remove portions of the metal film other than the portion in the hole opened in the insulating layer 302. In the formation of the plug 303, tungsten may be deposited after forming a barrier metal layer by using titanium or a titanium compound. For example, $SiO_2$ is used for the insulating layer 302. The upper surface of the insulating layer 302 may be planarized to adjust the thickness of the insulating layer 302.

Figure 3C:
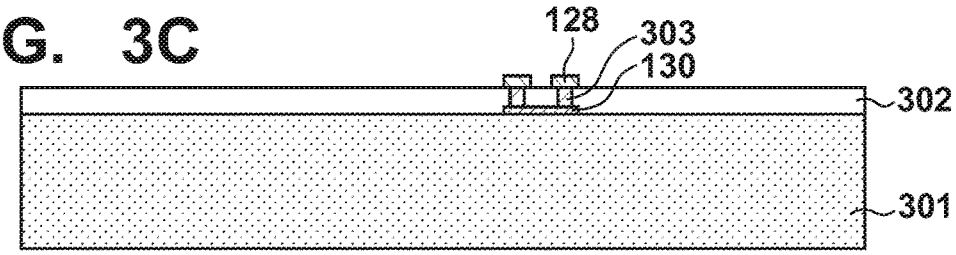

After the plug 303 is formed, the electrically conductive member 128 is formed on the insulating layer 302 as shown in FIG. 3C. For example, aluminum can be used for the electrically conductive member 128. A metal film made of aluminum for forming the electrically conductive member 128 is deposited on the insulating layer 302, and a mask pattern having a desired shape is formed on the metal film. Next, the electrically conductive member 128 is formed by etching the metal film via the opening of the mask pattern.

Figure 3D:
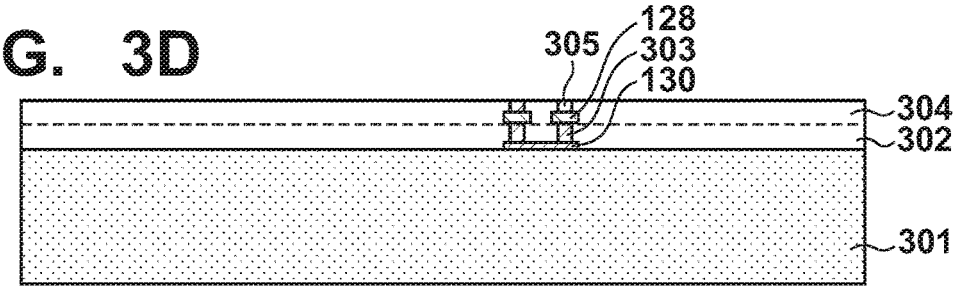

As shown in FIG. 3D, after the electrically conductive member 128 is formed, an insulating layer 304 which is to be a part of the insulating film 140*b* is formed on the insulating layer 302 and the electrically conductive member 128, and the plug 305 is formed in the insulating layer 304. The plug 305 may include the barrier metal layer and the metal layer or only the metal layer. For example, titanium or a titanium compound is used for the barrier metal layer. Also, for example, tungsten is used for the metal layer. For example, $SiO_2$ is used for the insulating layer 304.

Figure 3E:
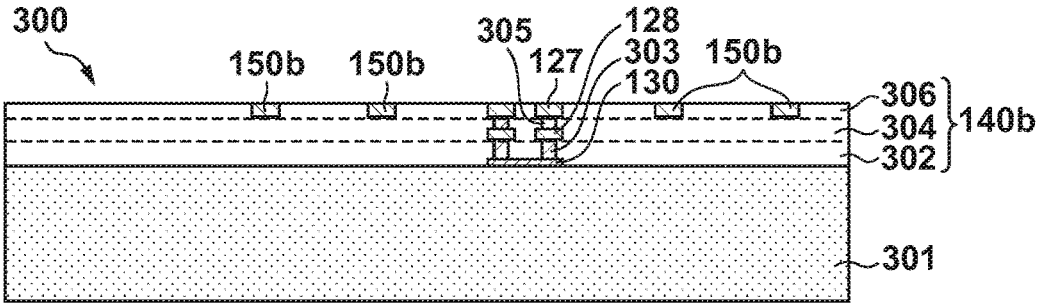
Figure 3F:
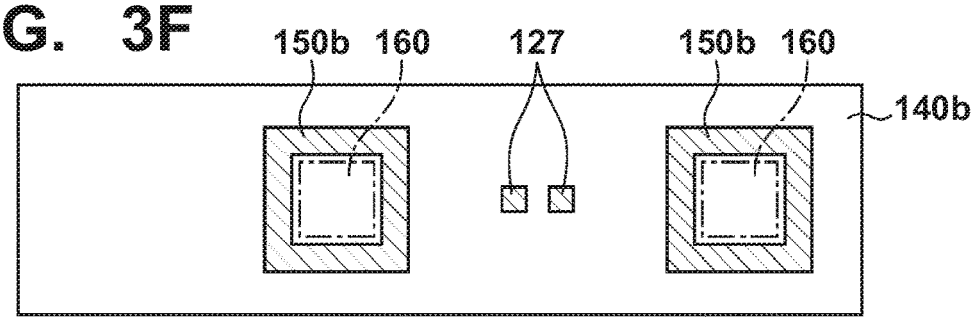

After the insulating layer 304 and the plug 305 are formed, an insulating layer 306 which is to be part of the insulating film 140*b*, the electrically conductive member 127, and the electrically conductive members 150*b* are formed on the insulating layer 304 as shown in FIG. 3E. FIG. 3F is a plan view of FIG. 3E, and each electrically conductive member 150*b* is arranged as a guard ring structure surrounding the periphery of the corresponding liquid supply port 160 to be formed in a later process.

The electrically conductive member 127 and the electrically conductive members 150*b* can be formed simultaneously by using, for example, the damascene method. In this case, the electrically conductive member 127 and the electrically conductive members 150*b* can be formed by the same material and have the same height in the direction intersecting with the principal surface of the substrate 301. As described above, each of the electrically conductive member 127 and the electrically conductive members 150*b* can include a corresponding one of the barrier metal layers 127*b* and 152*b* and a corresponding one of the metal layers 127*a* and 151*b*. For example, tantalum, a tantalum compound, titanium, or a titanium compound is used for the barrier metal layers 127*b* and 152*b*. Also, for example, copper is used for the metal layers 127*a* and 151*b*. In addition, for example, $SiO_2$ is used for the insulating layer 306.

The substrate 300 is formed by the above processes. Although the substrate 300 includes two layers of the electrically conductive members 127 and 128 in this embodiment, the number of layers on which the electrically conductive members are to be arranged is not limited to this. The number of layers on which the electrically conductive members are to be arranged may be one or may be three or more. The electrically conductive members 127 and 128 and the plugs 303 and 305 form the electrically conductive pattern 120*b* of the liquid discharge head substrate 100 described above. In addition, although the insulating film 140*b* includes the insulating layer 302, the insulating layer 304, and the insulating layer 306 in this embodiment, the number of insulating layers to be included in the insulating film 140*b* can be changed appropriately in accordance with the number of layers on which the electrically conductive members are to be arranged.

In addition, although each electrically conductive member 150*b* has a one layer structure in this embodiment, it may have two or more layers. In a case in which the electrically conductive member 150*b* has a structure composed of two or more layers, one layer of the electrically conductive member 150*b* among the plurality of layers of the electrically conductive member 150*b* will be exposed at the surface of the substrate 300. Also, in a case in which the electrically conductive member 150*b* is formed by two or more layers, the electrically conductive members 150*b* arranged on the respective layers may be connected to each other by a plug.

Figure 4A:
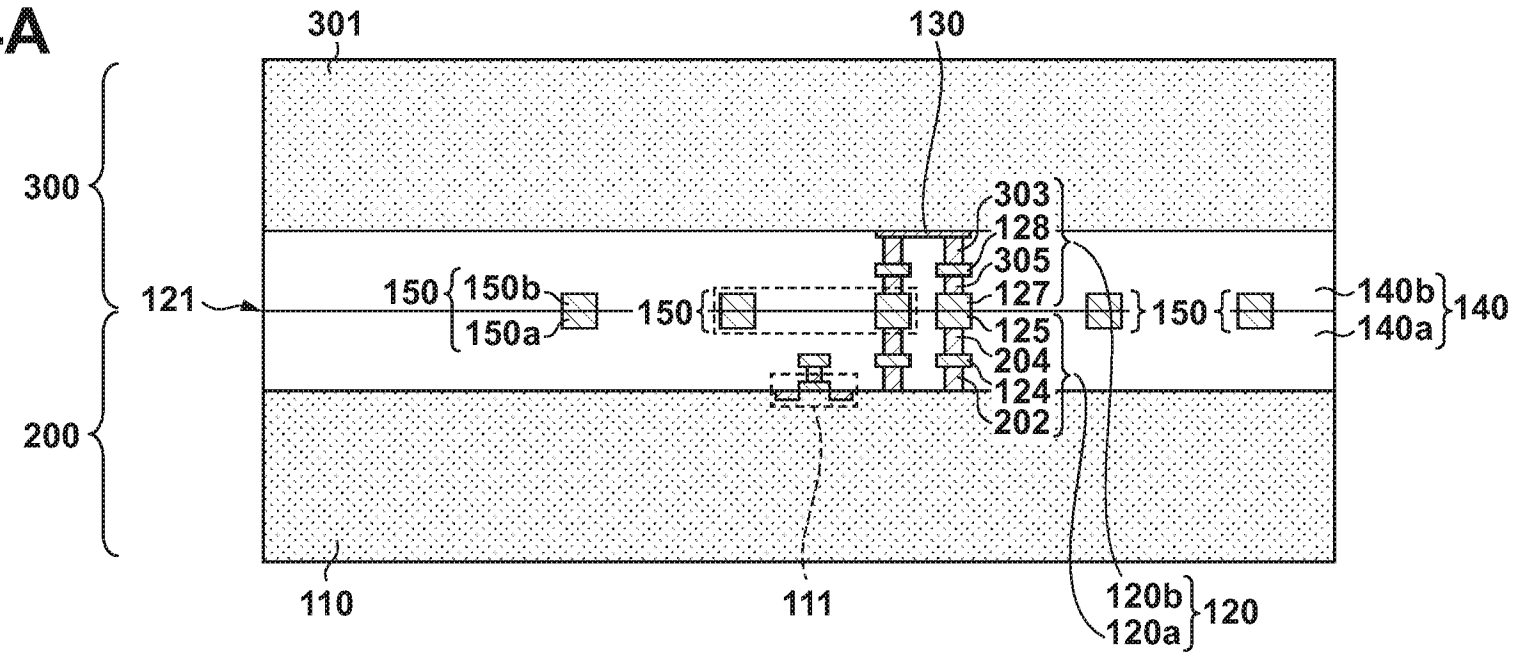
FIGS. 4A and 4B are views showing an example of the manufacturing method of the liquid discharge head substrate of FIG. 1A.

Next, as shown in FIG. 4A, the substrate 200 and the substrate 300 formed by using the processes described above are bonded so as to electrically connect the semiconductor element 111 and the liquid discharge element 130. More specifically, the substrate 200 and the substrate 300 are bonded together so as to bond the electrically conductive member 125 with the electrically conductive member 127, the insulating film 140*a* to the insulating film 140*b*, and each electrically conductive member 150*a* to each electrically conductive member 150*b*. For example, the substrate 200 and the substrate 300 may be bonded by employing a so-called room-temperature bonding method. In this case, the insulating film 140*a* and the insulating film 140*b* can be bonded by a covalent bond. The electrically conductive member 125 and the electrically conductive member 127 can be bonded by a metallic bond. In a similar manner, the electrically conductive member 150*a* and the electrically conductive member 150*b* can be bonded by a metallic bond.

Figure 4B:
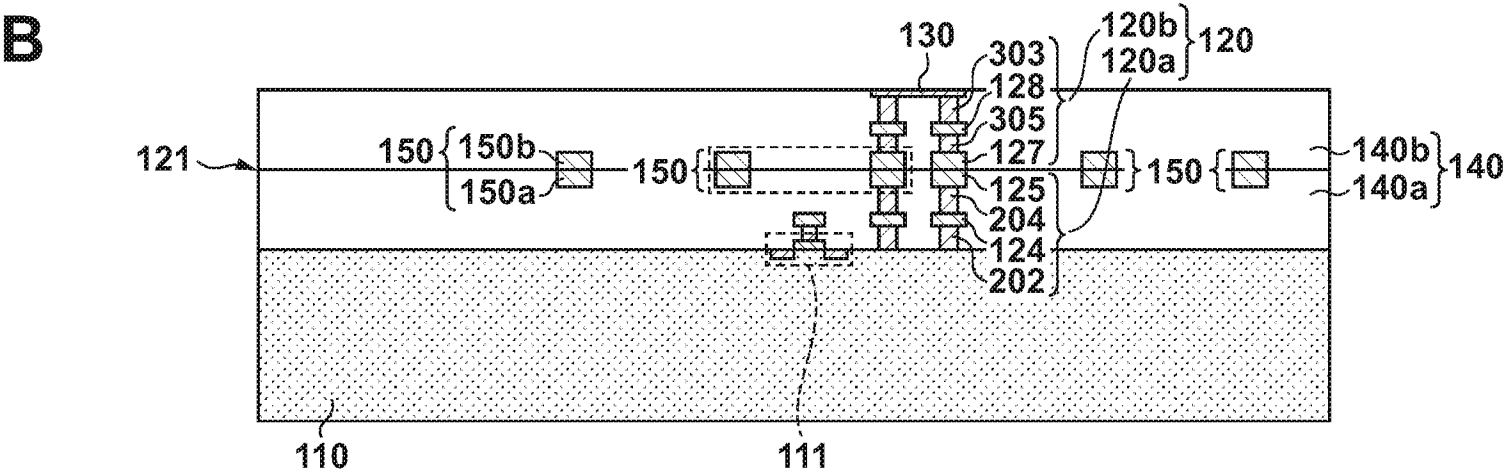

After the bonding of the substrate 200 and the substrate 300, the substrate 301 of the substrate 300 is removed as shown in FIG. 4B. The entire substrate 301 may be removed. Next, the common liquid chamber 161, which is arranged at the bottom of the substrate 110 on the side opposite to the principal surface on which the semiconductor element 111 is arranged, and the liquid supply ports 160 which extend from the common liquid chamber 161 to the upper surface of the insulating film 140 are formed. The liquid supply ports 160 and the common liquid chamber 161 can be formed by using methods such as dry etching, wet etching, a laser process, sand blasting, machining, or the like. The liquid supply ports 160 and the common liquid chamber 161 may be formed by using the same method or by using different methods. In addition, either the liquid supply ports 160 or the common liquid chamber 161 may be formed first. Each liquid supply port 160 is formed so as to be surrounded by the inner periphery of the corresponding electrically conductive pattern 150 having the guard ring structure. The liquid discharge head substrate 100 shown in FIG. 1A is formed by these processes.

The liquid discharge head substrate 100 manufactured by the above-described processes is mounted to the liquid discharge apparatus and used. When the liquid discharge apparatus is used, the common liquid chamber 161 and the liquid supply ports 160 in the liquid discharge head substrate 100 are filled with a liquid to be discharged from the liquid discharge element 130. This liquid has a slightly alkaline pH level of 8 to 10 in most cases. In this embodiment, the solubility, with respect to the liquid, of $SiO_2$ forming the insulating film 140*a* and the insulating film 140*b* depends on the molecular density of $SiO_2$. $SiO_2$ will dissolve more easily when its molecular density is lower. This is not limited to the case of $SiO_2$ and applies similarly to various kinds of insulating materials which are used as the insulating films 140*a* and 140*b*. Compared to the molecular density of the bulk of $SiO_2$ of the insulating film 140*a* and the insulating film 140*b*, the molecular density of $SiO_2$ of the bonding surface 121 can be relatively low. Hence, $SiO_2$ dissolves more easily at the bonding portion of the insulating film 140*a* and the insulating film 140*b*. On the other hand, the solubility of copper forming the electrically conductive patterns 150 (the electrically conductive members 150*a* and the electrically conductive members 150*b*) having the guard ring structure according to this embodiment depends on the Pourbaix diagram shown in FIG. 8. Since copper will belong to an inert region or a $Cu_2O$ passive state region if the potential is 0 V or less in a range in which the pH level of the liquid is 8 to 10, the bonding portion of each electrically conductive member 150*a* and each electrically conductive member 150*b* is in a stable state with respect to the liquid. That is, the resistance of the bonding portion of each electrically conductive member 150*a* and each electrically conductive member 150*b* to the liquid is higher than the resistance of the bonding portion of the insulating film 140*a* and the insulating film 140*b* to the liquid. Furthermore, in this embodiment, the electrically conductive members 150*a* and 150*b* include the metal layers 151*a* and 151*b* made of copper and the barrier metal layers 152*a* and 152*b* each having a stacked structure. The resistance of the electrically conductive patterns 150 and the bonding portions of the electrically conductive members 150*a* and 150*b* to the infiltration of the liquid is higher in a case in which the barrier metal layers 152*a* and 152*b* are arranged than in a case in which the insulating film 140 made of copper and $SiO_2$ is in direct contact with the liquid. As a result, in a case in which the liquid enters from the wall surface of each liquid supply port 160 along the bonding surface 121 of the insulating film 140 in the liquid discharge head substrate 100 shown in FIG. 1A, the electrically conductive patterns 150 having the guard ring structure will play a role in suppressing the entry of the liquid. This will suppress the liquid from entering the electrically conductive pattern 120, and improve the reliability of the liquid discharge head substrate 100.

Although it is shown in this embodiment that the electrically conductive members 150*a* and the electrically conductive member 125 are formed simultaneously by using the same material, and that the electrically conductive members 150*b* and the electrically conductive member 127 are formed simultaneously by using the same material, the present invention is not limited to this. The electrically conductive members 150*a* and the electrically conductive member 125 can be formed separately by using different materials from each other, and the electrically conductive members 150*b* and the electrically conductive member 127 can be formed separately by using different materials from each other. In this case, for example, a metal can be used for the electrically conductive members 150*a* and 150*b*. More specifically, a material such as titanium, zirconium, hafnium, vanadium, niobium, tantalum, or the like or a compound of each of these materials can be used as the electrically conductive members 150*a* and 150*b*. Also, concerning the formation order in this case, either the electrically conductive members 150*a* or the electrically conductive member 125 can be formed first, and either the electrically conductive members 150*b* or the electrically conductive member 127 can be formed first. The material to be used for the electrically conductive members 150*a* and 150*b* need only be selected appropriately in accordance with the liquid to be used in the liquid discharge apparatus, and need only be a material that allows the resistance of the respective bonding portions of the electrically conductive members 150*a* and 150*b* to the liquid to be set higher than the resistance of the bonding portion of the insulating films 140*a* and 140*b* to the liquid. More specifically, by using electrical conductors as the electrically conductive members 150*a* and 150*b*, a resistance higher than that of the bonding portion of the insulating film 140*a* and the insulating film 140*b* can be obtained. In addition, a higher resistance can be obtained by using a metal for the electrically conductive members 150*a* and 150*b*.

Figure 5A:
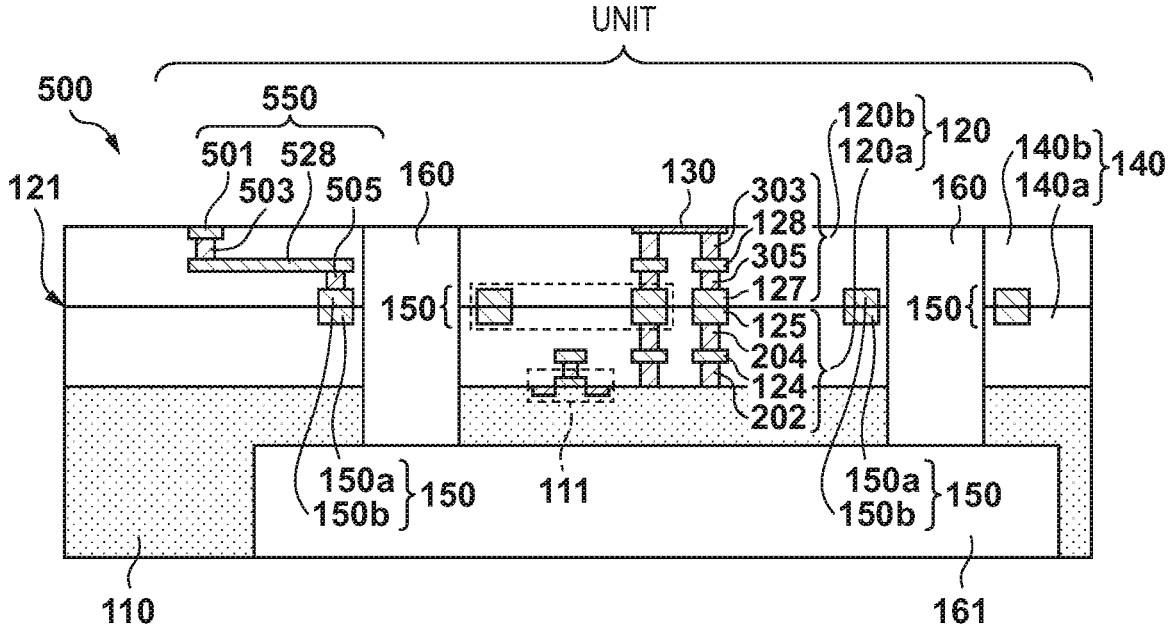
FIGS. 5A to 5C are views showing a modification of the liquid discharge head substrate of FIG. 1A.
Figure 5B:
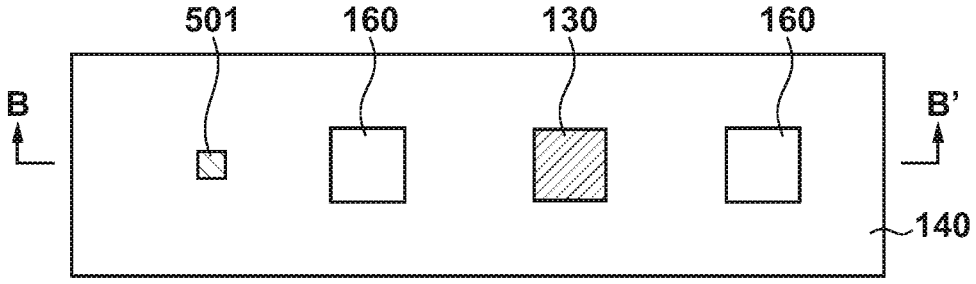

The structure and the manufacturing method of a liquid discharge head substrate according to the second embodiment of the present invention will be described next with reference to FIG. 5A to 5C. FIG. 5A is a sectional view showing an example of the arrangement of a liquid discharge head substrate 500 according to the second embodiment of the present invention, and FIG. 5B is a plan view of the liquid discharge head substrate 500. FIG. 5A is a view showing a section taken along a line B-B' of FIG. 5B.

Compared to a liquid discharge head substrate 100 described above, the liquid discharge head substrate 500 according to this embodiment further includes a potential control pattern 550 for controlling the potential of an electrically conductive pattern 150. More specifically, the liquid discharge head substrate 500 includes an electrode pad 501, plugs 503 and 505, and an electrically conductive member 528 as the potential control pattern 550. Components other than this may be structured similarly to those of the liquid discharge head substrate 100.

The manufacturing method of the liquid discharge head substrate 500 will be described next. Since a substrate 200 which is a portion from a substrate 110 to a bonding surface 121 of the liquid discharge head substrate 500 may be manufactured by a method similar to that described above, a description will be omitted here. The formation of a substrate 300' which forms a portion on the side of the bonding surface 121 to a liquid discharge element 130 of the liquid discharge head substrate 500 will be described next.

Figure 5C:
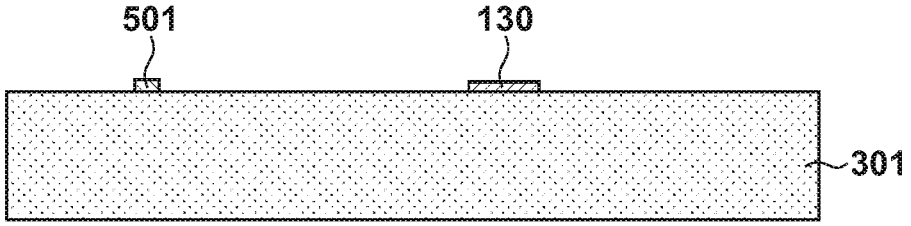

First, as shown in FIG. 5C, the electrode pad 501 and the liquid discharge element 130 which is a heat generating resistive element are formed on a substrate 301. At this time, the liquid discharge element 130 or the electrode pad 501 may be formed first. For example, a metal such as aluminum, gold, or the like is used for the electrode pad 501.

Next, an insulating layer 302 which is to be a part of an insulating film 140*b* is formed on the liquid discharge element 130 and the substrate 301. After the insulating layer 302 is formed, a hole is opened at a predetermined position in the insulating layer 302, and a plug 303 and the plug 503 are formed in the hole. Other than the process of additionally forming a hole to form the plug 503 and embedding the plug 503, processes similar to the processes for forming the plug 303 shown in FIG. 3B described above will be used. In a similar manner, the electrically conductive member 528 is formed by being added to an electrically conductive member 128 in the process for forming the electrically conductive member 128 shown in FIG. 3C described above. Also, in a similar manner, the plug 505 is formed by being added to a plug 305 in the process for forming the plug 305 shown in FIG. 3D described above. As shown in FIG. 5A, the electrically conductive pattern 150 (electrically conductive members 150*a* and 150*b*) is electrically connected to the electrode pad 501.

Figure 8:
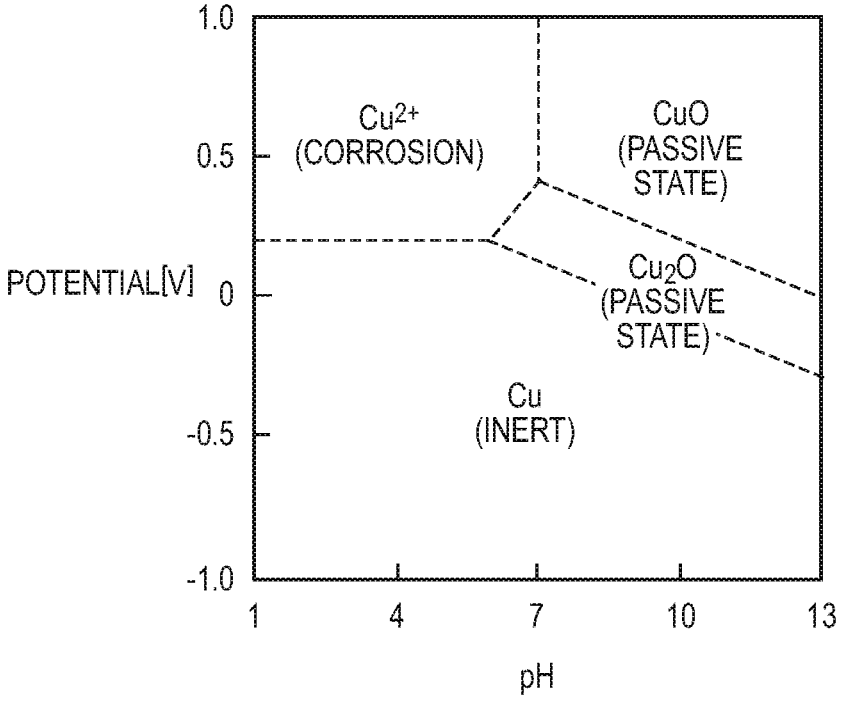
FIG. 8 is a Pourbaix diagram for copper.

In the liquid discharge head substrate 500 according to this embodiment, it is possible to apply a potential to the electrically conductive pattern 150 from the outside. When using the liquid discharge apparatus, a negative potential is applied to the electrically conductive pattern 150 by an external power supply via the electrode pad 501 while the liquid discharge head substrate 500 operates. In a case in which the electrically conductive pattern 150 (the electrically conductive members 150*a* and 150*b*) is formed by copper or the like in a similar manner to the first embodiment, copper will become more stable when a negative potential is applied as compared with a case in which a potential equals 0 as shown in FIG. 8. Hence, the resistance of the bonding portion of the electrically conductive member 150*a* and the electrically conductive member 150*b* to the liquid is further increased. As a result, the entry of the liquid to the electrically conductive pattern 120 is suppressed more than that in the case of the liquid discharge head substrate 100 according to the first embodiment as described above, and it is possible to increase the reliability of the liquid discharge head substrate 500. The potential control pattern 550 may be arranged for each unit UNIT. The potential control pattern 550 may be shared by a plurality of units UNIT. The operation performed by a user to supply a potential to the electrically conductive pattern 150 via the electrode pad 501 can be simplified in a case in which the potential control pattern 550 is shared by the plurality of units UNIT.

Figure 6A:
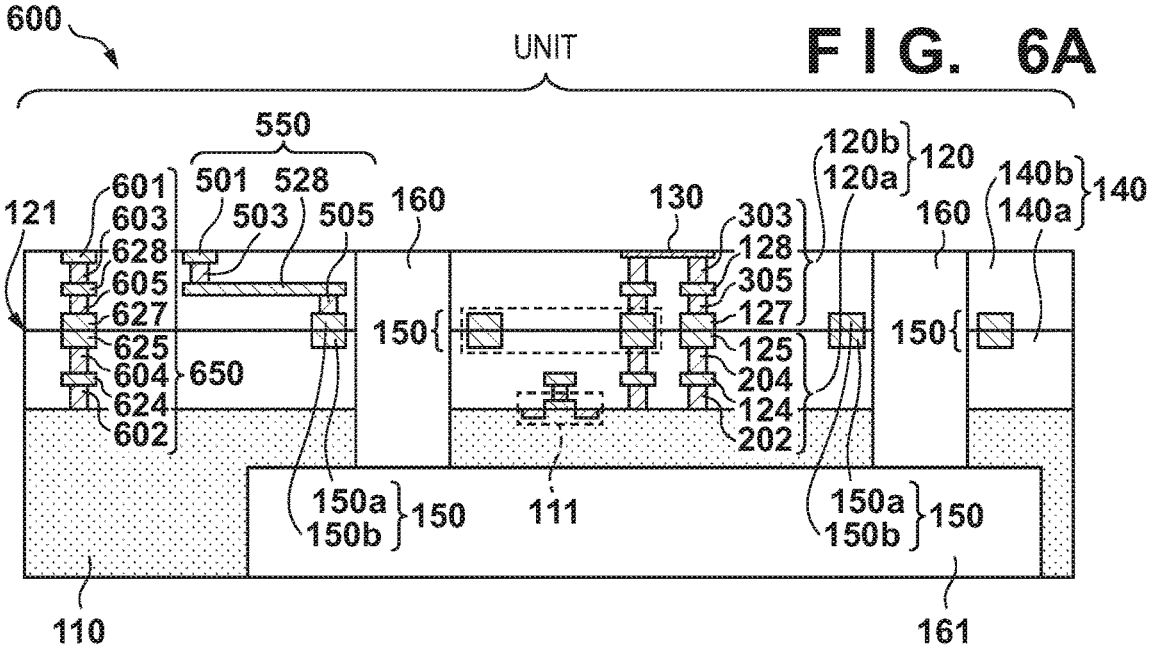
FIGS. 6A to 6D are views showing a modification of the liquid discharge head substrate of FIG. 5A.
Figure 6B:
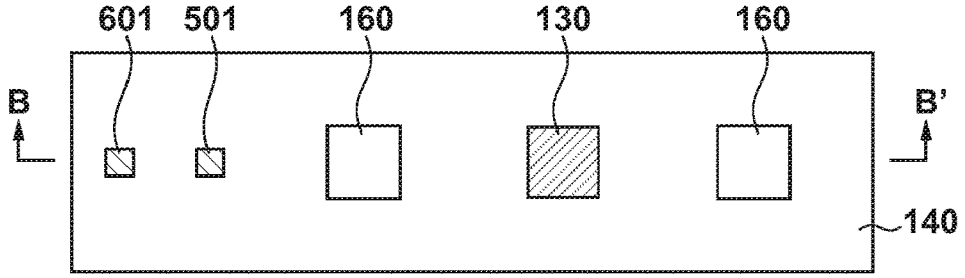
Figure 6C:
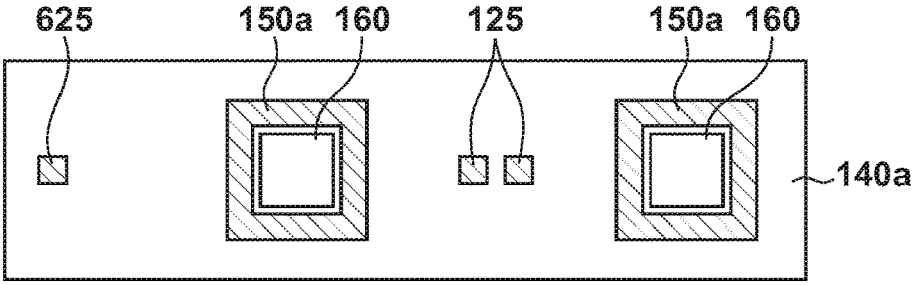
Figure 6D:
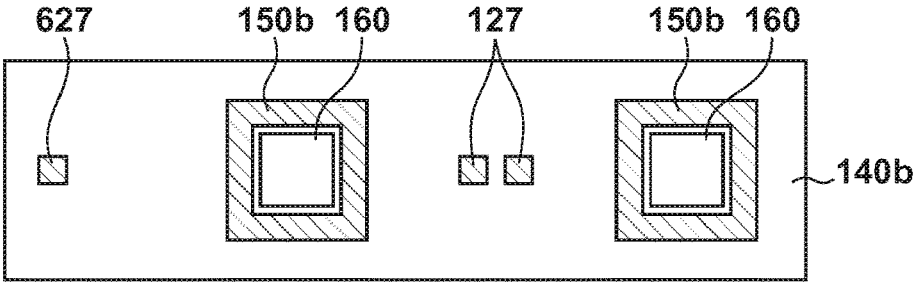

The structure and the manufacturing method of a liquid discharge head substrate according to the third embodiment of the present invention will be described next with reference to FIG. 6A to 6D. FIG. 6A is a sectional view showing an example of the arrangement of a liquid discharge head substrate 600 according to the third embodiment of the present invention, and FIG. 6B is a plan view of the liquid discharge head substrate 600. FIG. 6A is a view showing a section taken along a line B-B' of FIG. 6B. FIGS. 6C and 6D are a top view and a bottom view, respectively of a bonding surface 121 shown in FIG. 6A.

Compared to a liquid discharge head substrate 500 described above, the liquid discharge head substrate 600 according to this embodiment further includes a potential difference measurement pattern 650 for measuring the potential difference between an electrically conductive pattern 150 and a substrate 110. More specifically, the liquid discharge head substrate 600 according to this embodiment includes an electrode pad 601, plugs 602, 603, 604, and 605, and electrically conductive members 624, 625, 627, and 628 as the potential difference measurement pattern 650. Components other than this may be structured similarly to those of the liquid discharge head substrate 500.

The plug 602 may be formed simultaneously in the process for forming a plug 202 shown in FIG. 2B described above. In a similar manner, the electrically conductive member 624 may be formed simultaneously with an electrically conductive member 124, the plug 604 may be formed simultaneously with a plug 204, and the electrically conductive member 625 may be performed simultaneously with an electrically conductive member 125 when a substrate 200 is to be manufactured. In addition, the electrode pad 601 may be formed simultaneously with an electrode pad 501 shown in FIG. 5C described above. In a similar manner, the plug 603 may be formed simultaneously with plugs 303 and 503, the electrically conductive member 628 may be formed simultaneously with electrically conductive members 128 and 528, the plug 605 may be formed simultaneously with plugs 305 and 505, and the electrically conductive member 627 may be formed simultaneously with an electrically conductive member 127.

The potential of the substrate 110 can be measured in the liquid discharge head substrate 600 according to this embodiment. Since liquid supply ports 160 are filled by a liquid such as ink when the liquid discharge head substrate 600 is to be used, the liquid and the substrate 110 will have the same potential. That is, the electrode pad 601 and the liquid will have the same potential. At this time, it is possible to detect an electrical short circuit between the substrate 110 and the electrically conductive pattern 150 (electrically conductive members 150*a* and 150*b*) via the liquid by connecting an external power supply to the electrode pad 501 and the electrode pad 601. In a case in which a short circuit has occurred between the substrate 110 and the electrically conductive pattern 150, there is a possibility that the insulating film 140 is dissolving at the bonding portion of an insulating film 140*a* and an insulating film 140*b*. Although the entry of the liquid will be suppressed by the electrically conductive pattern 150 in the manner described above, there is a possibility that the liquid will enter an electrically conductive pattern 120 by further changes over time. Hence, by detecting the occurrence of a short circuit between the substrate 110 and the electrically conductive pattern 150, it is possible to display, for example, a message prompting the user to prepare a liquid cartridge for replacement on a display unit of a discharge apparatus or that of a personal computer used by the user to use the discharge apparatus. A liquid discharge apparatus that is easier to use can be implemented by arranging the potential difference measurement pattern 650 in the liquid discharge head substrate 600. In addition, a potential control pattern 550 and the potential difference measurement pattern 650 may be arranged for each unit UNIT or shared among a plurality of units UNIT. In a case in which the potential control pattern 550 and the potential difference measurement pattern 650 are to be arranged for each unit UNIT, a short circuit can be detected for each unit UNIT. In a case in which the potential control pattern 550 and the potential difference measurement pattern 650 are shared among the plurality of units UNIT, a short circuit which is included in a shared range can be detected. The range shared by the potential control pattern 550 and the potential difference measurement pattern 650 can be determined between the units UNIT in accordance with the specification of the liquid discharge head substrate 600.

Figure 7A:
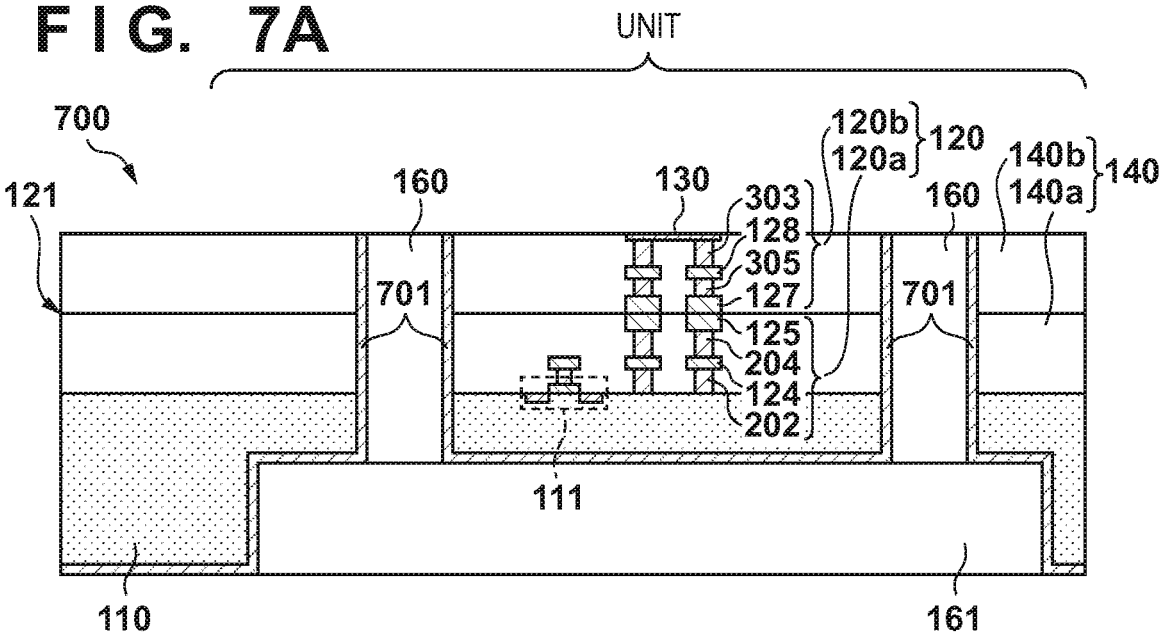
FIGS. 7A to 7D are views showing another modification of the liquid discharge head substrate of FIG. 1A.
Figure 7B:
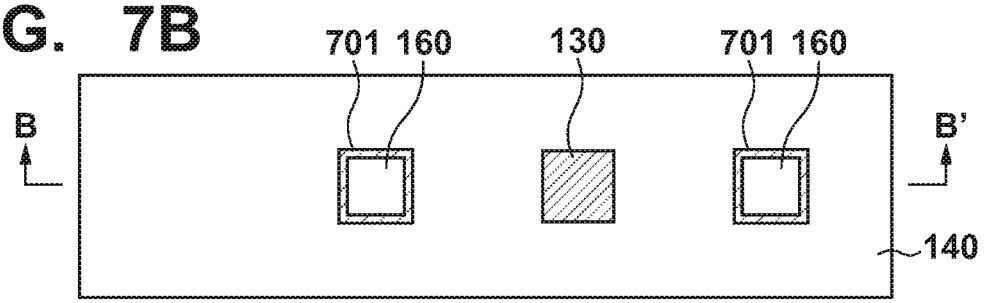
Figure 7C:
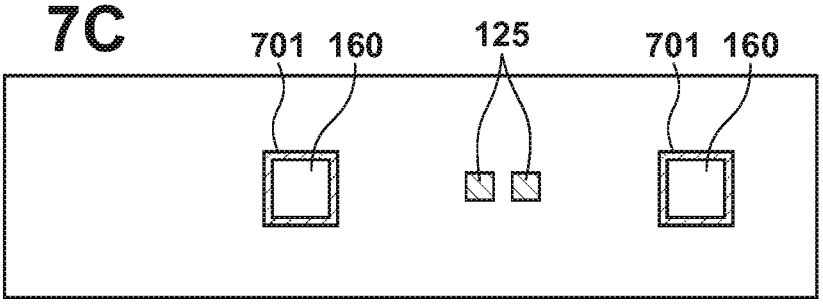
Figure 7D:
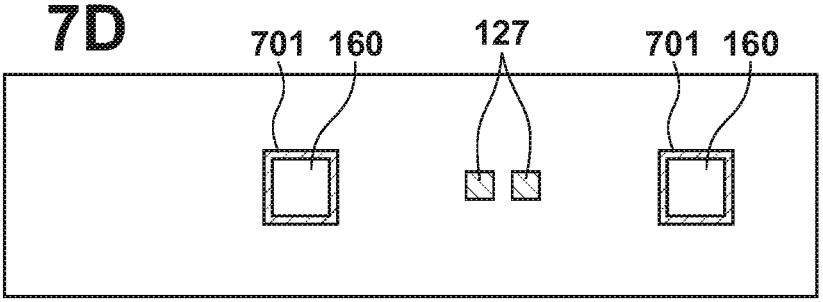

The structure and the manufacturing method of a liquid discharge head substrate according to the fourth embodiment of the present invention will be described next with reference to FIG. 7A to 7D. FIG. 7A is a sectional view showing an example of the arrangement of a liquid discharge head substrate 700 according to the fourth embodiment of the present invention, and FIG. 7B is a plan view of the liquid discharge head substrate 700. FIG. 7A is a view showing a section taken along a line B-B' of FIG. 7B. FIGS. 7C and 7D are a top view and a bottom view, respectively of a bonding surface 121 shown in FIG. 7A.

Compared to a liquid discharge head substrate 100 described above, the liquid discharge head substrate 700 according to this embodiment does not include electrically conductive patterns 150 having a guard ring structure, but includes a protective pattern 701. The protective pattern 701 is arranged so as to cover at least the bonding portion of an insulating film 140*a* and an insulating film 140*b* of the wall surfaces of each liquid supply port 160. In other words, the protective pattern 701 is arranged so as to cover at least the bonding surface 121 of the wall surfaces of an insulating film 140 where the liquid supply ports 160 extend through. As shown in FIG. 7A, of the insulating film 140 and a substrate 110, the protective pattern 701 may entirely cover all of the wall surfaces which are formed where the liquid supply ports 160 extend through. Furthermore, the protective pattern 701 may cover, among the substrate 110, portions of a common liquid chamber 161 and a surface on a side opposite to the principal surface on which a semiconductor element 111 is arranged. Components other than this may be structured similarly to those of the liquid discharge head substrate 100.

The manufacturing method of the liquid discharge head substrate 700 will be described next. Other than the fact that the electrically conductive patterns 150 are not formed, processes similar to those of the liquid discharge head substrate 100 described above can be used to form components from the liquid supply ports 160 to the common liquid chamber 161 in the liquid discharge head substrate 700. After the liquid supply ports 160 and the common liquid chamber 161 are formed, the protective pattern 701 is formed. It is possible to appropriately select a deposition method such as the CVD method, the sputtering method, the atomic layer deposition (ALD) method, or the like as the formation method of the protective pattern 701. There may be a case in which a mechanical structure with a high aspect ratio is formed in the liquid supply ports 160 and the common liquid chamber 161. In order to reliably form the protective pattern 701 on the wall surfaces of the liquid supply ports 160, the protective pattern 701 may be formed by using the atomic layer deposition method which has good throwing power. Titanium oxide, titanium, zirconium, hafnium, vanadium, niobium, tantalum, or the like can be used for the protective pattern 701. The protective pattern 701 may have a one layer structure using a material described above or may have a stacked structure having two or more layers. For example, the protective pattern may have a stacked structure using a material described above and an insulating material. In this case, the layer of the insulating material may be arranged on the side of the insulating film 140 or on the side that will come into contact with the liquid.

In the structure shown in FIG. 7A, the protective pattern 701 on a liquid discharge element 130 and the insulating film 140 has been removed. After a material film of the protective pattern 701 has been deposited on the entire surface of the surfaces to be exposed of the substrate 110, the insulating film 140, and the like, the protective pattern 701 may be formed by forming a mask pattern by using a photoresist and removing unnecessary portions by dry etching or wet etching. Alternatively, the protective pattern 701 may be formed by using a lift-off method in which a lift-off pattern is formed before the protective pattern 701 is formed and the unnecessary portion is removed together with the lift-off pattern after the deposition of the material film which is to be the protective pattern 701. Also, the material film need not be removed in a case in which the material film to be used as the protective pattern 701 is to be used as the anti-cavitation film described above. A known technique can be selected appropriately to form the protective pattern 701.

The liquid discharge head substrate 700 is manufactured by the above processes. In the liquid discharge head substrate 700 manufactured in this manner, the entry of a liquid via the bonding surface 121 is suppressed by the protective pattern 701 and an operation is performed to fill the liquid discharge head substrate with a liquid such as ink. This prevents the liquid from entering an electrically conductive pattern 120, and it becomes possible to improve the reliability of the liquid discharge head substrate 700 in a similar manner to the embodiments described above.

A potential control pattern, as described above in the second embodiment, for controlling the potential of the protective pattern 701 may also be added to the liquid discharge head substrate 700 according to this embodiment. In addition, in the structure shown in FIG. 7A, the protective pattern 701 covers the insulating film 140 and the substrate 110. However, in a case in which the protective pattern 701 does not cover the substrate 110, a potential difference measurement pattern, as described above in the third embodiment, for measuring the potential difference between the protective pattern 701 and the substrate 110 may be added to the liquid discharge head substrate 700. In either case, the potential control pattern or the potential difference measurement pattern may be arranged for each unit UNIT or shared among a plurality of units UNIT.

The embodiments according to the present invention have been described above. However, the present invention is not limited to these embodiments, as a matter of course, and the above-described embodiments can appropriately be changed or combined without departing from the scope of the present invention. For example, the protective pattern 701 shown in FIG. 7A may be arranged in the liquid discharge head substrate 100 which includes the electrically conductive patterns 150 having the guard ring structure shown in FIG. 1A. By arranging, in addition to the electrically conductive pattern 150, the protective pattern 701 so as to cover at least the bonding portion between the insulating film 140*a* and the insulating film 140*b* of the wall surfaces of the liquid supply ports 160, it is possible to further improve the reliability of the liquid discharge head substrate 100.

OTHER EMBODIMENTS

Figure 9A:
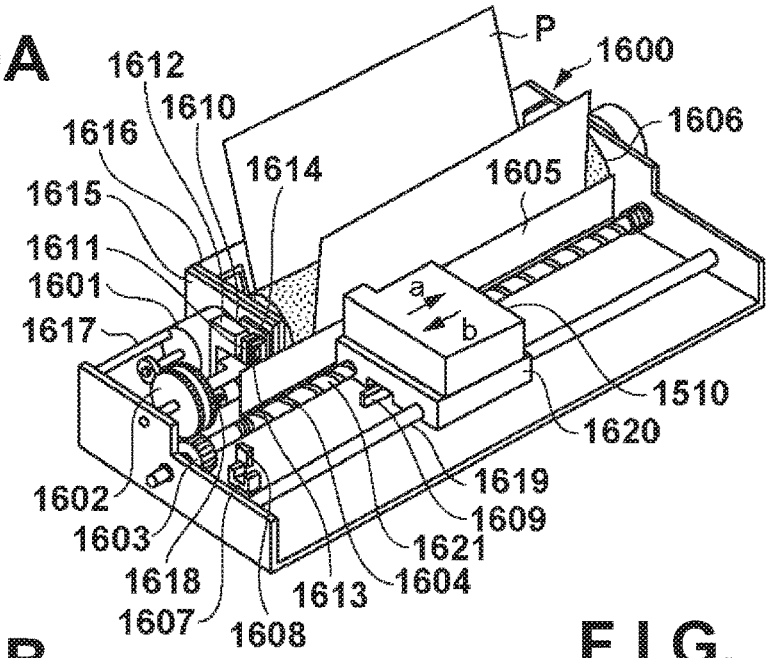
FIGS. 9A to 9D are views each showing an example of the arrangement of a liquid discharge apparatus that uses the liquid discharge head substrates shown in FIGS. 1A, 5A, 6A, and 7A.

A liquid discharge apparatus using the above-described liquid discharge head substrate 100, 500, 600, or 700 will described. FIG. 9A exemplifies the internal arrangement of a liquid discharge apparatus 1600 typified by an inkjet printer, a facsimile apparatus, or a copying machine. In this example, the liquid discharge apparatus may also be called a printing apparatus. The liquid discharge apparatus 1600 includes a liquid discharge head 1510 that discharges a liquid (in this example, ink or a printing material) to a predetermined medium P (in this example, a printing medium such as paper). In this example, the liquid discharge head may also be called a printhead. The liquid discharge head 1510 is mounted on a carriage 1620, and the carriage 1620 can be attached to a lead screw 1621 having a helical groove 1604. The lead screw 1621 can rotate in synchronization with rotation of a driving motor 1601 via driving force transmission gears 1602 and 1603. The liquid discharge head 1510 can move in a direction indicated by an arrow a or b along a guide 1619 together with the carriage 1620.

The medium P is pressed by a paper press plate 1605 in the carriage moving direction and fixed to a platen 1606. The liquid discharge apparatus 1600 performs liquid discharge (in this example, printing) to the medium P conveyed on the platen 1606 by a conveyance unit (not shown) by reciprocally moving the liquid discharge head 1510.

The liquid discharge apparatus 1600 confirms the position of a lever 1609 provided on the carriage 1620 via photocouplers 1607 and 1608, and switches the rotational direction of the driving motor 1601. A support member 1610 supports a cap member 1611 for covering the nozzle (liquid orifice or simply orifice) of the liquid discharge head 1510. A suction portion 1612 performs recovery processing of the liquid discharge head 1510 by sucking the interior of the cap member 1611 via an intra-cap opening 1613. A lever 1617 is provided to start recovery processing by suction, and moves along with movement of a cam 1618 engaged with the carriage 1620. A driving force from the driving motor 1601 is controlled by a well-known transmission mechanism such as a clutch switch.

A main body support plate 1616 supports a moving member 1615 and a cleaning blade 1614. The moving member 1615 moves the cleaning blade 1614 to perform recovery processing of the liquid discharge head 1510 by wiping. The liquid discharge apparatus 1600 includes a controller (not shown) and the controller controls driving of each mechanism described above.

Figure 9B:
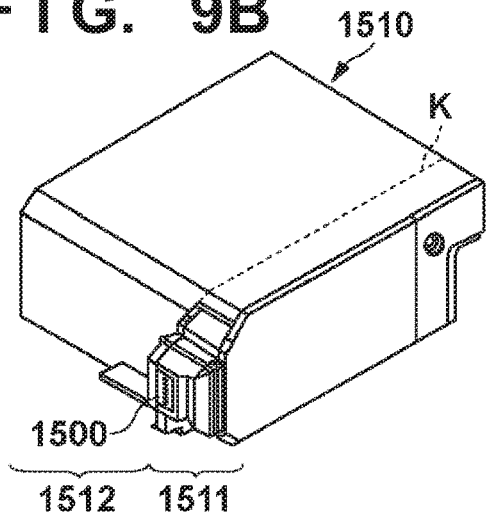

FIG. 9B exemplifies the outer appearance of the liquid discharge head 1510. The liquid discharge head 1510 can include a head portion 1511 having a plurality of nozzles 1500, and a tank (liquid storage portion) 1512 that holds a liquid to be supplied to the head portion 1511. The tank 1512 and the head portion 1511 can be separated at, for example, a broken line K and the tank 1512 is interchangeable. The liquid discharge head 1510 has an electrical contact (not shown) for receiving an electrical signal from the carriage 1620 and discharges a liquid in accordance with the electrical signal. The tank 1512 has a fibrous or porous liquid holding member (not shown) and the liquid holding member can hold a liquid.

Figure 9C:
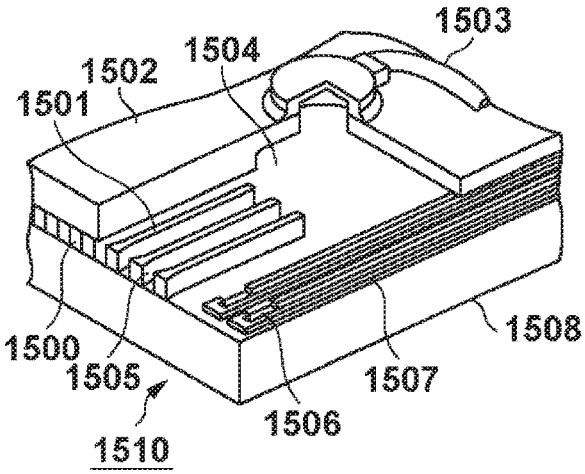

FIG. 9C exemplifies the internal arrangement of the liquid discharge head 1510. The liquid discharge head 1510 includes a base 1508, channel wall members 1501 that are arranged on the base 1508 and form channels 1505, and a top plate 1502 having a liquid supply path 1503. The base 1508 may be any one of the above-described liquid discharge head substrates 100, 500, 600, and 700. As discharge elements or liquid discharge elements, heaters 1506 (also referred to as electrothermal transducers or heat generating resistive elements) are arrayed on the substrate (liquid discharge head substrate) of the liquid discharge head 1510 in correspondence with the respective nozzles 1500. Each heater 1506 is driven to generate heat by turning on a driving element (a switching element such as a transistor) provided in correspondence with the heater 1506.

A liquid from the liquid supply path 1503 is stored in a common liquid chamber 1504 and supplied to each nozzle 1500 via the corresponding channel 1505. The liquid supplied to each nozzle 1500 is discharged from the nozzle 1500 in response to driving of the heater 1506 corresponding to the nozzle 1500.

Figure 9D:
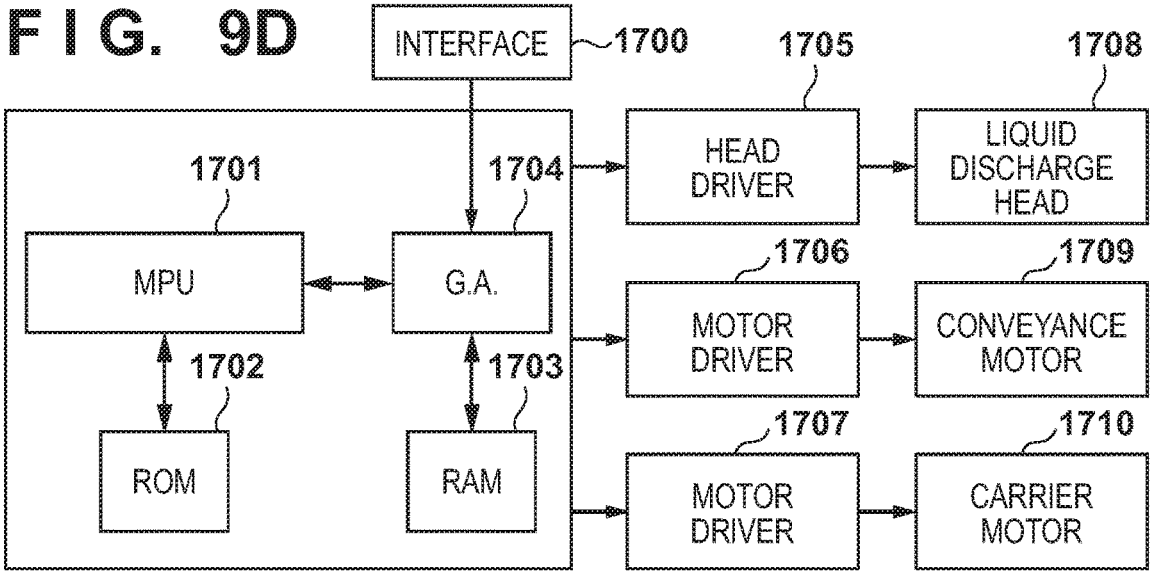

FIG. 9D exemplifies the system arrangement of the liquid discharge apparatus 1600. The liquid discharge apparatus 1600 includes an interface 1700, a MPU 1701, a ROM 1702, a RAM 1703, and a gate array (GA) 1704. The interface 1700 receives from the outside an external signal for executing liquid discharge. The ROM 1702 stores a control program to be executed by the MPU 1701. The RAM 1703 saves various signals and data such as the above-mentioned external signal for liquid discharge and data supplied to the liquid discharge head 1708. The gate array 1704 performs supply control of data to the liquid discharge head 1708 and control of data transfer between the interface 1700, the MPU 1701, and the RAM 1703.

The liquid discharge apparatus 1600 further includes a head driver 1705, motor drivers 1706 and 1707, a conveyance motor 1709, and a carrier motor 1710. The carrier motor 1710 conveys a liquid discharge head 1708. The conveyance motor 1709 conveys the medium P. The head driver 1705 drives the liquid discharge head 1708. The motor drivers 1706 and 1707 drive the conveyance motor 1709 and the carrier motor 1710, respectively.

When a driving signal is input to the interface 1700, it can be converted into data for liquid discharge between the gate array 1704 and the MPU 1701. Each mechanism performs a desired operation in accordance with this data, and the liquid discharge head 1708 is driven in this manner.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-148023, filed Aug. 6, 2018 which is hereby incorporated by reference herein in its entirety.

What is claimed is:

1. A liquid discharge head substrate comprising:

a substrate;

a semiconductor element arranged on a principal surface of the substrate;

a liquid discharge element arranged above the principal surface and configured to discharge a liquid;

an insulating film arranged between the principal surface and the liquid discharge element;

a liquid supply port which extends through the substrate and the insulating film;

a first electrically conductive pattern arranged in the insulating film to electrically connect the semiconductor element and the liquid discharge element; and a second electrically conductive pattern arranged in the insulating film so as to surround the liquid supply port in an orthogonal projection with respect to the principal surface, wherein the insulating film includes a first insulating film and a second insulating film arranged between the first insulating film and the liquid discharge element, the first insulating film and the second insulating film are bonded at a bonding surface extending in a direction along the principal surface, the first electrically conductive pattern includes a first electrically conductive member arranged in the first insulating film and a second electrically conductive member arranged in the second insulating film, the first electrically conductive member and the second electrically conductive member are bonded at the bonding surface, the second electrically conductive pattern includes a third electrically conductive member arranged in the first insulating film and a fourth electrically conductive member arranged in the second insulating film, and the third electrically conductive member and the fourth electrically conductive member are bonded at the bonding surface.

2. The substrate according to claim 1, wherein a bonding portion of the first electrically conductive member and the second electrically conductive member and a bonding portion of the third electrically conductive member and the fourth electrically conductive member are formed by the same material.

3. The substrate according to claim 1, wherein the first electrically conductive member and the third electrically conductive member have the same height in a direction intersecting with the principal surface, and the second electrically conductive member and the fourth electrically conductive member have the same height in a direction intersecting with the principal surface.

4. The substrate according to claim 1, wherein the third electrically conductive member and the fourth electrically conductive member contain a metal.

5. The substrate according to claim 1, wherein the third electrically conductive member and the fourth electrically conductive member contain copper.

6. The substrate according to claim 5, wherein the third electrically conductive member includes a first metal layer which contains copper and a first barrier metal layer which is arranged between the first metal layer and the first insulating film, and the fourth electrically conductive member includes a second metal layer which contains copper and a second barrier metal layer which is arranged between the second metal layer and the second insulating film.

7. The substrate according to claim 1, wherein the first electrically conductive pattern is not arranged between the second electrically conductive pattern and the liquid supply port surrounded by the second electrically conductive pattern.

8. The substrate according to claim 1, wherein a resistance of a bonding portion of the third electrically conductive member and the fourth electrically conductive member to the liquid is higher than a resistance of a bonding portion of the first insulating film and the second insulating film to the liquid.

9. The substrate according to claim 1, wherein a protective pattern is arranged so as to cover at least a bonding portion of the first insulating film and the second insulating film of wall surfaces of the liquid supply port.

10. The substrate according to claim 1, wherein the second electrically conductive pattern is electrically insulated from the first electrically conductive pattern.

11. The substrate according to claim 1, further comprising:

a potential control pattern for controlling a potential of the second electrically conductive pattern.

12. The substrate according to claim 11, wherein a negative potential is applied to the second electrically conductive pattern when the liquid discharge head substrate is operated.

13. The substrate according to claim 1, further comprising:

a potential difference measurement pattern configured to measure a potential difference between the second electrically conductive pattern and the substrate.

14. A liquid discharge head comprising:

a liquid discharge head substrate according to claim 1; and a discharge port in which liquid discharge is controlled by the liquid discharge head substrate.

15. A liquid discharge apparatus comprising:

a liquid discharge head according to claim 14; and a unit configured to supply a driving signal to cause the liquid discharge head to discharge a liquid.

16. A liquid discharge head substrate comprising:

a substrate;

a semiconductor element arranged on a principal surface of the substrate;

a liquid discharge element arranged above the principal surface;

an insulating film arranged between the principal surface and the liquid discharge element;

a liquid supply port which extends through the substrate and the insulating film;

an electrically conductive pattern arranged in the insulating film to electrically connect the semiconductor element and the liquid discharge element, wherein the insulating film includes a first insulating film and a second insulating film arranged between the first insulating film and the liquid discharge element, the first insulating film and the second insulating film are bonded at a bonding surface extending in a direction along the principal surface, the electrically conductive pattern includes a first electrically conductive member arranged in the first insulating film and a second electrically conductive member arranged in the second insulating film, the first electrically conductive member and the second electrically conductive member are bonded at the bonding surface, and a protective pattern is arranged so as to cover at least a bonding portion of the first insulating film and the second insulating film of wall surfaces of the liquid supply port.

17. The substrate according to claim 16, wherein of the insulating film and the substrate, the protective pattern entirely covers the wall surfaces which are formed where the liquid supply port extends through.

18. The substrate according to claim 16, wherein the protective pattern contains at least one material selected from the group consisting of titanium, zirconium, hafnium, vanadium, niobium, and tantalum.

19. The substrate according to claim 16, wherein the protective pattern is electrically conductive, and the protective pattern is electrically insulated from the electrically conductive pattern.

20. The substrate according to claim 19, further comprising:

a potential control pattern configured to control a potential of the protective pattern.

21. The substrate according to claim 20, wherein a negative potential is applied to the protective pattern when the liquid discharge head substrate is operated.

22. The substrate according to claim 16, further comprising:

a potential difference measurement pattern configured to measure a potential difference between the protective pattern and the substrate.

* * * * *